US006558058B2

(12) United States Patent
Masumoto

(10) Patent No.: US 6,558,058 B2
(45) Date of Patent: May 6, 2003

(54) PRINTER HEAD OF A COATING TOOL

(75) Inventor: Hiroaki Masumoto, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 09/749,700

(22) Filed: Dec. 28, 2000

(65) Prior Publication Data

US 2001/0007622 A1 Jul. 12, 2001

(30) Foreign Application Priority Data

Jan. 6, 2000 (JP) ..... 2000-000619

(51) Int. Cl.[7] ..... B41J 29/02; B41J 11/60; B05C 1/00; B05C 1/14

(52) U.S. Cl. ..... 400/695; 400/697; 400/700; 118/200; 118/257

(58) Field of Search ..... 400/695, 697, 400/700; 118/200, 257

(56) References Cited

U.S. PATENT DOCUMENTS

| | | | | |
|---|---|---|---|---|
| 4,390,119 A | | 6/1983 | Smetana | |
| 4,853,074 A | | 8/1989 | Harp | |
| 4,876,892 A | * | 10/1989 | Claassen | 118/406 |
| 4,891,260 A | * | 1/1990 | Kunkel et al. | 428/220 |
| 4,928,134 A | * | 5/1990 | Hasegawa et al. | 346/76 |
| 4,997,516 A | | 3/1991 | Manusch | |
| 5,430,904 A | * | 7/1995 | Ono et al. | 15/104.94 |
| 5,490,898 A | * | 2/1996 | Koyama | 400/695 |
| 5,785,437 A | * | 7/1998 | Koyama et al. | 400/193 |
| 5,936,653 A | * | 8/1999 | Yamaguchi et al. | 347/216 |
| 5,942,036 A | * | 8/1999 | You | 400/696 |
| 6,171,397 B1 | * | 1/2001 | Mitsuya | 400/696 |

FOREIGN PATENT DOCUMENTS

EP 0742111 A2 11/1996

OTHER PUBLICATIONS

Weast, Robert, Handbook of Chemistry and Physics, CRC Press, Inc. 66th Edition.*

* cited by examiner

*Primary Examiner*—Daniel J. Colilla
*Assistant Examiner*—Marvin P Crenshaw
(74) *Attorney, Agent, or Firm*—Birch, Stewart, Kolasch & Birch, LLP

(57) ABSTRACT

A coating tool has a printer head capable of securing a smooth traveling of a transfer tape having a correcting paint or a paste applied thereto by preventing adhesion of the transfer tape to the printer head thereby securely transferring and coating the correcting paint or paste to the surface of a target object. The printer head is supported by the coating tool and projects from an opening thereof and is provided with an elastic tongue portion and a guide plate both of which are integrally formed with the printer head by using a resin material for forming the printer head, which has a small coefficient of surface friction of less than 5 whereby the adhesion of the transfer tape to the transfer tape traveling of the printer head taking place due to a small amount of a correcting paint or paste adhering to rear surface of the transfer tape is prevented and a smooth traveling of the transfer tape is secured thereby performing the transfer and coating of the correcting paint or paste on the tape to the surface of the target object.

2 Claims, 4 Drawing Sheets

PRINTER HEAD OF A COATING TOOL

BACKGROUND OF THE INVENTION

1. Field of the Invention

The present invention relates to a printer head of a coating tool for transferring to a target object a correcting paint, a paste or the like which adheres to the surface of a transfer tape by pressing the rear surface of the transfer tape against the target object.

2. Prior Art

A printer head of a conventional coating tool has an elastic tongue made of a resin material, which elastically urges a pressure to a rear surface of the transfer tape, and further has a guide plate formed integral with the elastic tongue and adapted to regulate the lateral oscillations of the transfer tape on both sides thereof at the time of traveling of the transfer tape.

However, the printer head of the conventional coating tool having the above-described structure involves the problem that where the transfer tape travelling on the printer head is of a type having a paste-coated surface, since the transfer tape in its wound state is in the form of a so-called pancake, a very small amount of paste (a paste pool) may adhere to the rear surface of the transfer tape thereby it may easily come in contact with a transfer tape traveling surface of the printer head so that a smooth delivery and take-up operation of the transfer tape is hindered and the correcting paint or paste on the transfer tape can not be securely transferred and coated to the surface of the target object.

Further, the phenomenon that the smooth traveling of the transfer tape is hindered by the adhesion of the paste to the transfer tape traveling surface of the printer head due to the adhesion of a small amount of the paste to the rear surface of the transfer tape causes an excessive tensile force applied on the transfer tape itself so that there is a fear of a stretching of the transfer tape to an excessive degree or even a breakage of the tape.

SUMMARY OF THE INVENTION

The present invention has been made to solve the above-described problems of the printer head of the conventional coating tool. Accordingly, an object of the invention is to provide a printer head of a coating tool, which is simple in structure and which can securely transfer and coat a correcting paint or paste applied to a transfer tape to the surface of a target object. Another object of the invention is to provide a printer head of a coating tool, which enables smooth delivery and take-up of a transfer tape even in case a small amount of a paint or paste adheres to the rear surface of the transfer tape.

According to an aspect of the invention a printer head of a coating tool, about which a transfer tape in its travel from a tape delivery to a tape take-up mechanism of the coating tool is moved, is provided, said printer head being supported by and projecting from a main body of the coating tool and having an elastic tongue portion forming a top end of the printer head and serving for elastically pressing the rear surface of the transfer tape, wherein at least said elastic tongue portion of the printer head being formed of a resin material having a small coefficient of surface friction. The elastic tongue portion can be integral with the base portion of the printer head or alternatively can be a separate part.

According to another aspect of the invention a printer head of a coating tool, about which a transfer tape in its travel from a tape delivery to a tape take-up mechanism of the coating tool is moved, is provided, said printer head being supported by and projecting from a main body of the coating tool and having an elastic tongue portion forming a top end of the printer head and serving for elastically pressing the rear surface of the transfer tape, wherein at least the top end of said elastic tongue portion of the printer head being covered with a covering material made of a resin material having a small coefficient of surface friction.

According to yet another aspect of the invention a printer head of a coating tool, about which a transfer tape in its travel from tape delivery to a tape take-up mechanism of the coating tool is moved, is provided said printer head being supported by and projecting from a main body of the coating tool and having an elastic tongue portion forming a top end of the printer head and serving for elastically pressing the rear surface of the transfer tape, which includes an elastic tongue portion, wherein said elastic tongue portion of the printer head having a finely corrugated pattern formed on at least one of the surfaces thereof.

In either case, i.e. if the whole or at least the top end of the elastic tongue is made of the above-described resin materials or covered by a resin material, a coefficient of surface friction is substantially reduced thereby to become less than 5, preferably in the order of 1.1 to 4.

With the above-described structure, even when a small amount of paste adhering to the rear surface of the transfer tape tends to adhere to the transfer tape traveling surface of the printer head, since the traveling surface is integrally formed of a resin material having a small coefficient of surface friction or having a finely corrugated pattern, that is, a so called crepe pattern, the transfer tape can be prevented from adhering to the elastic tongue and a smooth traveling of the tape can be secured thereby performing the transfer and coating of the correcting paint or the paste applied on the surface of the transfer tape to the transfer surface of the target object.

Further, by such smooth traveling of the transfer tape, any excessive tensile force which may be generated due to the adhesion of the tape to the printer head is not applied onto the transfer tape itself so that such inconvenience is prevented that an excessive expansion of the transfer tape or even a breakage can occur.

DETAILED DESCRIPTION OF THE PREFERRED EMBODIMENTS OF THE INVENTION

Figure 1:
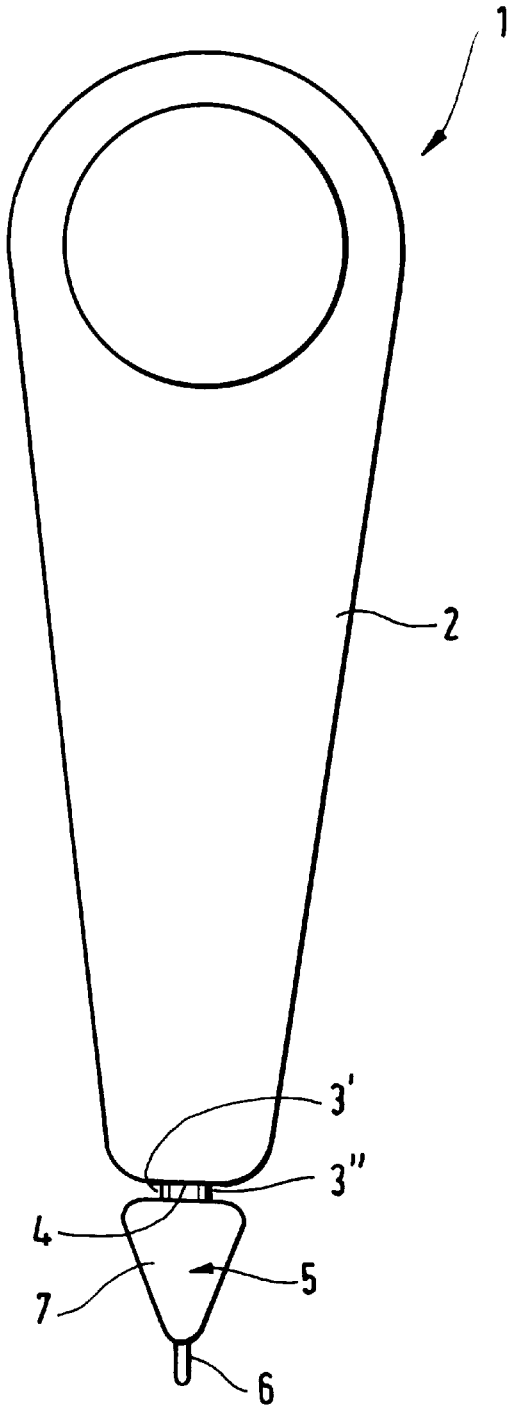
FIG. 1 is a front view of a coating tool having a printer head according to one embodiment of the present invention.
Figure 2:
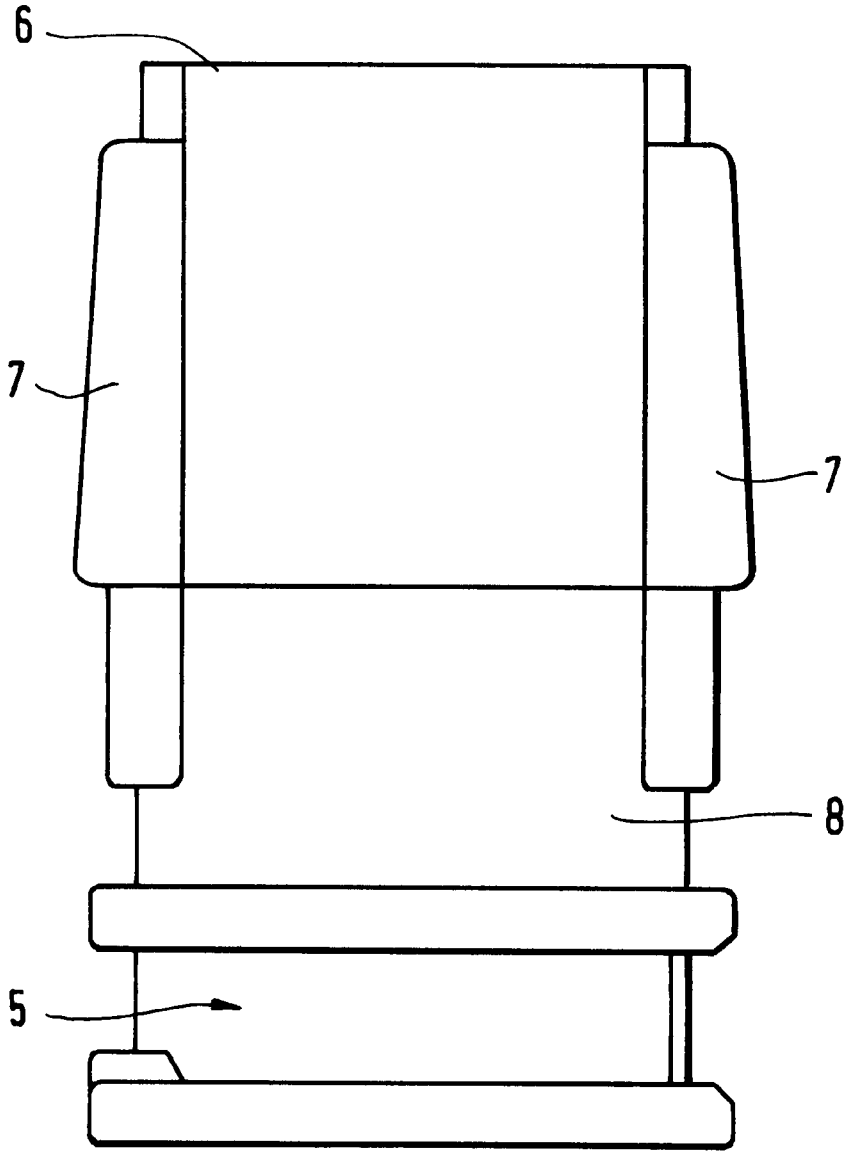
FIG. 2 is a front view of the printer head forming part of the coating tool shown in FIG. 1.

Preferred embodiments of the present invention will now be described with reference to the accompanying drawings.

In the drawings, reference numeral 1 designates a coating tool according to one embodiment of the present invention. The coating tool 1 can be of a separable type and comprises: a main body 2 having an opening 4 and incorporating therein a transfer tape delivery and take-up mechanism. A pancake of wound unused transfer tape 3' is disposed on the shaft of a large gear of the transfer tape delivery and take-up mechanism and a small gear thereof meshes with the large gear and has a take-up reel mounted on the same shaft as that of the pancake so as to take up a waste transfer tape 3". The mechanism operates such that the unused transfer tape 3' is delivered from the pancake and the waste transfer tape 3" is taken up by the take-up reel. The coating tool further comprises a printer head 5 about which the transfer tape is guides during its travel from the pancake to the take-up reel for transferring and coating a correcting paint or paste applied on the surface of the transfer tape to the surface of a target object by exerting a pressure to the rear surface of the unused transfer tape delivered from the pancake so as to transfer the correcting paint or paste of the unused tape 3' to the surface of the target object.

The printer head 5 forming part of the coating tool 1 has a base portion for mounting to the main body 2 for protruding through the opening 4 thereof and an elastic tongue portion 6 having a top end for elastically pressing the rear surface of the transfer tape 3, and a guide plate 7 adapted to control the lateral oscillations of the transfer tape 3 on both sides thereof during the traveling of the transfer tape. The elastic tongue portion 6 and the guide plate 7 are formed integral with the printer head 5 and are formed of a resin material having a coefficient of surface friction of as small as or less than 5, preferably in the order of 1.1 to 4. The resin material may be one of the group of materials comprising a fluorine-contained resin, silicone resin, stearate resin or a resin material having a crepe pattern on the surface thereof.

With the above-described structure of the printer head 5, there is the possibility that a small amount of the correcting paint or paste applied on the surface of the unused transfer tape 3' adheres to the rear surface of the tape 3' because the unused transfer tape 3' is in its wound state on the pancake within the main body 2 of the coating tool 1. However even when such a small amount of the correcting paint or paste tends to adhere to a transfer tape traveling surface 8 of the printer head 5, since that surface 8 has a small coefficient of surface friction when sliding on the transfer tape due to the use of the resin material having a small kinetic coefficient of surface friction of, for example, less than 5 or preferably in the order of 1.1 to 4 or, in lieu thereof, the resin material having a crepe or finely corrugated pattern on the surface thereof, it is possible to prevent the unused transfer tape 3' from adhering to the transfer tape traveling surface 8 of the printer head 5 and to secure a smooth traveling of the transfer tape 3 so that the correcting paint or paste applied on the surface of the transfer tape can be securely transferred and coated to the surface of the target object.

Further, by such smooth traveling of the transfer tape 3, no excessive tensile force due to the adhesion of the tape to the printer head is generated and it is also possible to prevent the occurrence of such inconvenience as an excessive expansion or breakage of the transfer tape 3.

Figure 3:
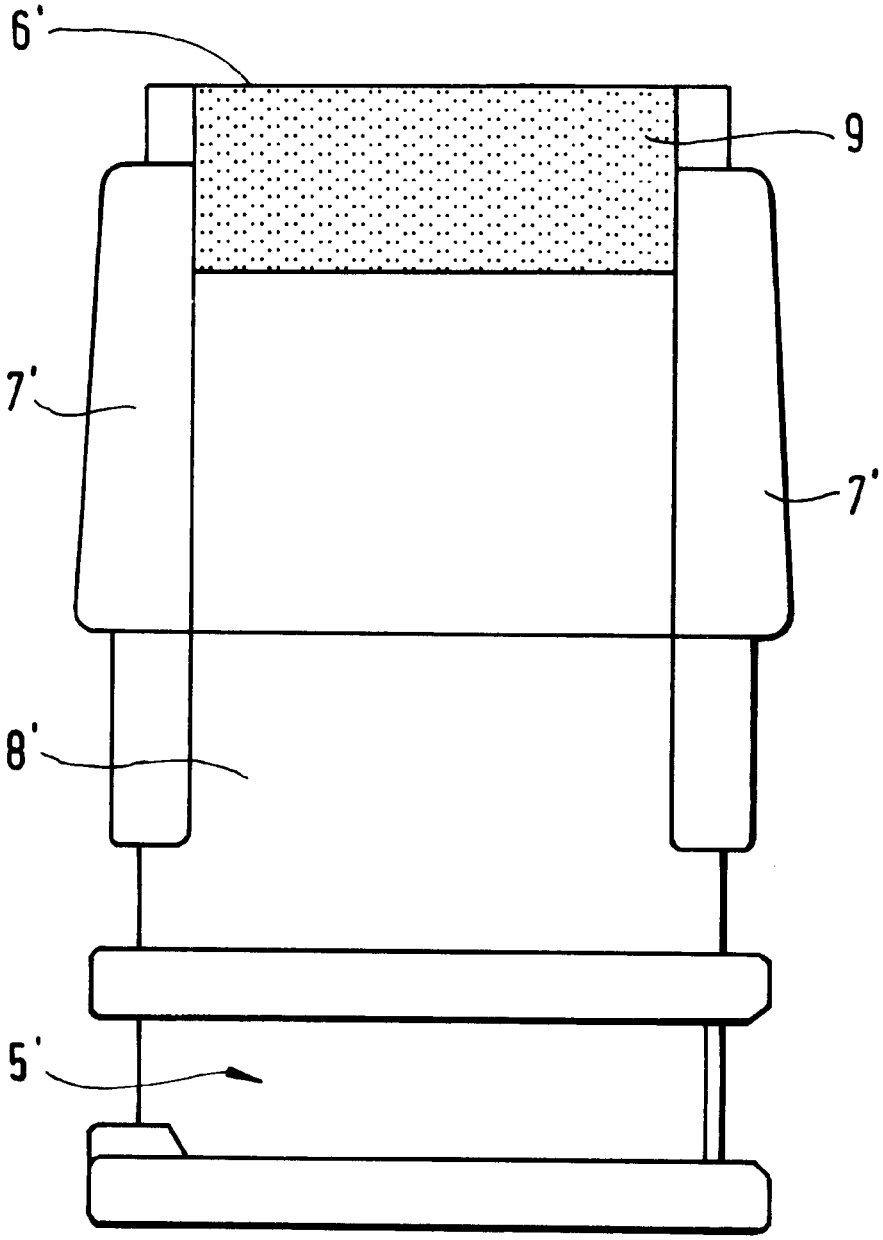
FIG. 3 is a front view of a printer head according to another embodiment of the present invention.
Figure 4:
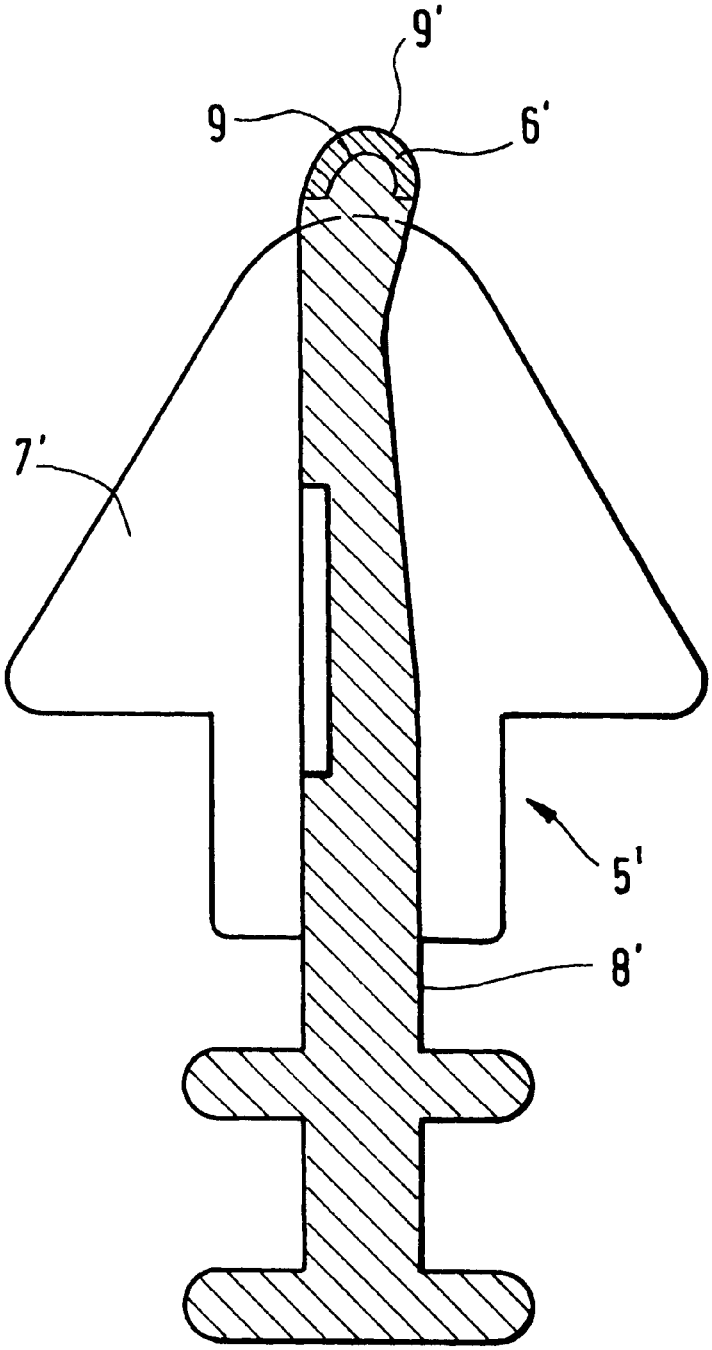
FIG. 4 is an enlarged sectional view of the printer head shown in FIG. 3.

FIGS. 3 and 4 show a printer head 5' of a coating tool 1' according to another embodiment of the present invention. This printer head 5' is formed integral with the main body of the coating tool 1' by using a resin material and comprises an elastic tongue portion 6' formed at the top end thereof so as to elastically press the rear surface of the transfer tape, and a guide plate 7' for regulating the lateral oscillations of the transfer tape on both sides thereof at the time of traveling of the transfer tape. Further, at least the top end of the elastic tongue 6' is covered with a covering resin material 9 such as polytetrafluorethylene having a coefficient of surface friction of less than 5 or preferably in the order of 1.1 to 4. Such covering may be provided on one of the surfaces of the elastic tongue 6' or on both of them. Consequently, as in the case of the first-described embodiment, the adhesion of the transfer tape to the transfer tape traveling surface 8' of the printer head 5' taking place due to a small amount of the correcting paint or paste adhering to the rear surface of the transfer tape 3' is prevented to secure a smooth traveling of the transfer tape 3 so that the transfer and coating of the correcting paint or paste to the surface of the target object can be performed securely and the adhesion of the transfer tape 3 to the printer head 5' can be prevented thereby preventing an excessive expansion or breakage of the transfer tape.

It should be noted that in the embodiment depicted in FIG. 4 where the elastic tongue portion 6(6') which is a part of the printer head 5(5') that has the highest possibility of adhesion to the transfer tape, only the top end 9' of the elastic tongue 6(6')portion may be partially formed with the resin material 9 having a coefficient of surface friction of less than 5 of preferably in the order of 1.1 to 4 or more concretely, a fluorine-contained resin, a silicone resin, a stearate resin or a resin material having a crepe pattern on the surface thereof.

As described above, the present invention has various excellent effects in that the adhesion of the transfer tape to the printer head taking place due to the presence of the correcting paint or paste applied on the transfer tape is prevented by forming the whole or a part of the printer head with a resin material having a small coefficient of surface friction or having a crepe pattern on the surface thereof or by covering it with such resin material, so that the smooth traveling of the transfer tape is secured and the transfer and coating of the correcting paint or paste to the surface of the target object can be performed securely whereby the user can perform a correcting paint or paste coating operation in a stabilized manner and such inconvenience as an excessive expansion of the transfer tape or breakage of the tape taking place due to the adhesion of the transfer tape to the printer head can be prevented.

What is claimed is:

1. A printer head of a coating tool, about which a transfer tape in its travel from a tape delivery to a tape take-up mechanism of the coating tool is moved, said printer head being supported by and projecting from a main body of the coating tool and having an elastic tongue portion, said elastic tongue portion forming a top end of the printer head and serving for sliding on said transfer tape and elastically pressing the rear surface of the transfer tape, wherein at least a top end of said elastic tongue portion of the printer head has a finely corrugated pattern providing a low kinetic coefficient of surface friction when sliding on the transfer tape.

2. The printer head according to claim 1, wherein said finely corrugated pattern provides a coefficient of surface friction of less than 5.

* * * * *